US005107959A

United States Patent [19]

Lubinski

[11] Patent Number: 5,107,959

[45] Date of Patent: Apr. 28, 1992

[54] KNOCK-DOWN BASE FOR PLATFORMS

[76] Inventor: Ronald Lubinski, 40 Centenial Heights Court, Meaford, Ontario, Canada, N0H 1Y8

[21] Appl. No.: 641,299

[22] Filed: Jan. 15, 1991

[51] Int. Cl.[5] ..... E04G 5/08

[52] U.S. Cl. ..... 182/222; 182/113

[58] Field of Search ..... 182/222, 223, 113

[56] References Cited

U.S. PATENT DOCUMENTS

| | | | |
|---|---|---|---|
| 3,374,861 | 3/1968 | Shaver | 182/222 |
| 4,037,824 | 7/1977 | Whitmer | 182/113 |
| 4,620,612 | 11/1986 | Enoki | 182/113 |
| 4,749,060 | 6/1988 | Vandelinde | 182/113 |
| 4,856,616 | 8/1989 | Anderson | 182/113 |
| 4,869,343 | 9/1989 | Anderson | 182/113 |
| 4,984,654 | 1/1991 | Anderson | 182/222 |

FOREIGN PATENT DOCUMENTS

| | | | |
|---|---|---|---|
| 2119720 | 4/1971 | Fed. Rep. of Germany | 182/222 |
| 1445355 | 5/1966 | France | 182/222 |

*Primary Examiner*—Reinaldo P. Machado

*Attorney, Agent, or Firm*—Mirek A. Waraksa

[57] ABSTRACT

A knock-down swing stage base includes a pair of extruded aluminum beams with generally C-shaped cross-sections. The beams are oriented parallel to one another and joined by identical aluminum cross-members. Each cross-member is integrally extruded with paired ribs defining a set of screw-receiving passages in a predetermined spacing arrangement. Sets of apertures are formed in the webs of the beams at regular intervals, each set observing the spacing arrangement characteristic of the set of screw-receiving passages. Each cross-member is located with its set of screw-receiving passages simultaneously registered with a set of apertures in one beam and a corresponding set in the other beam. Screws are used to releasably secured the cross-members to the beams. A combination of left-hand and right-hand screws are used to enhance resistance of the base to twisting. Brackets are shaped to receive and slide along an upper flange extruded with each beam. Each bracket carries an upwardly-directed length of pipe for receipt of a vertical post associated with an enclosing structure, such as a hand rail.

13 Claims, 4 Drawing Sheets

KNOCK-DOWN BASE FOR PLATFORMS

FIELD OF THE INVENTION

The invention relates to base structures for platforms, such as swing stages that are suspended by cables from buildings or other structures to support workmen.

BACKGROUND OF THE INVENTION

The term "swing stage" is used in the specification in the conventional sense of a suspended platform. Its principal structural component is referred to herein as a "swing stage base". Such a base is generally supported by a pair of stirrups and cables. In turn, the base supports flooring, workmen and equipment, and supports an enclosing structure such as a handrail assembly or mesh fastened to vertical posts. The base is the component most subject to mechanical stresses.

A swing stage base is commonly constructed of aluminum to reduce weight. The dominant design involves a ladder-like construction. The principal components are two parallel beams, each consisting of two horizontal box beams joined by vertical uprights. Horizontal cross-members join the lower box beams to form a unitary structure. The various components are hollow extruded members. The uprights and horizontal cross-members are retained in passages between opposing walls of the box beams. They are joined to the beams by swedging, constricting the member to enter one end of a passage and flaring the member at the opposite end to secure the junction. The equipment required to form such joints is comparatively expensive, but avoids any significant handworking of the basic aluminum materials. This is very desirable since aluminum components cannot be heated or repeatedly deformed in an elastic manner as readily as components formed of metals such as mild steel and cannot withstand comparable abue during hand-forming. It is also generally desirable to avoid hand-forming to whatever extent possible to reduce construction costs.

The prior ladder-like swing stages are difficult to transport. The enclosing structure generally poses no problem, usually being releasable from the base or knock-down. The vertical posts of the enclosing structure are often located in the interiors of the vertical uprights and can be readily removed. The principal problem is the construction of the swing stage base itself. This is a monolithic structure several feet wide and often up to thirty feet long. Transportation from the manufacturing site to a remote location, via train or truck, can be very costly. Even local transportation is difficult. Despite such limitations, the ladder-like swing stages still dominate the swing stage market.

SUMMARY OF THE INVENTION

In one aspect, the invention provides a knock-down swing stage base comprising a pair of aluminum beams in substantially parallel, spaced-apart relationship. The beams are preferably aluminum extrusions with upper and lower flanges and a vertical web. A multiplicity of aluminum cross-members, horizontally spaced relative to one another, are located between the beams. Each cross-member is integrally extruded with longitudinal structure defining at least one screw-receiving passage. Each cross-member has one end portion proximate to one beam and a longitudinally opposite end portion proximate to the other beam. Each cross-member end portion is releasably secured to the proximate beam in a junction including an aperture formed in the proximate beam and registered with the screw-receiving passage of the cross-member and a screw extending through the aperture into the screw-receiving passages and threaded into the longitudinal structure defining the screw-receiving passage. In preferred form, each cross-member is formed with a set of screw-receiving passages in a predetermined spacing arrangement (preferably in a rectangular arrangement at internal corners of the cross-member), the junctions comprises sets of apertures in the predetermined spacing arrangements, and several screws are used to secure each cross-member end portion.

There are several advantages to such a swing stage base. Most notably, it can be readily disassembled by releasing the various screws. The screw-retaining passages are integrally formed with the cross-members by extrusion thereby avoiding any significant handworking of the constituent aluminum material. The beams are preferably extruded as unitary structures, thereby avoiding any significant assembly costs and further working of the aluminum. Expensive swedging equipment can be entirely eliminated. The result is a relatively low-cost reliable swing stage that can be readily knocked down for transportation.

In another aspect, a swing stage base comprising a pair of elongate beams in substantially parallel, spaced-apart relationship is adapted to receive vertical posts of a supradjacent enclosing structure at various positions along the beams. A structure extends longitudinally along each beam and has a substantially uniform transverse cross-section. A plurality of brackets is associated with each beam. Each bracket comprises a complementary structure mated with the structure of the associated beam such that the bracket is secured against removal in any direction transverse to the longitudinal axis of the beam, but can slide along the beam to desired location. Each bracket comprises post-receiving means for releasably receiving and retaining a post of the enclosing structure in a generally vertical orientation. This arrangement adapts the base to receive a wide variety of enclosing structures and is particularly advantages if the beams are integrally extruded with the required interlocking structure.

In yet another aspect of the invention, a knock-down base incorporates webbed beams that are releasably joined in a manner that enhances resistance to twisting of the base. The base comprises a pair of aluminum beams in substantially parallel, spaced-apart relationship. Each beams has a generally vertical web. A multiplicity of aluminum cross-members are located between the beams and in horizontally spaced-apart relationship. Each cross-member is integrally extruded with longitudinal structure defining a longitudinal screw-receiving passage. Each end portion of the cross-members is releasably joined to the proximate beam in a junction comprising an aperture formed in the web of the proximate beam and registered with the screw-receiving passage of the cross-member, and a screw extending through the aperture into the screw-receiving passage, and threaded into the longitudinal structure defining the screw-receiving passage. A preselected number of screws that are left-oriented relative to the beam through which they extend (preferably at least those proximate to corners of the base) have a right-hand screw thread. A preselected number of screws that are right-oriented relative to the beam through which they extend (once again, preferably at least those proximate to corners of the base) have a left-hand screw thread. This arrangement resists the tendency for the base to twist about a horizontal axis perpendicular to the beams. For purposes of this specification, the term "left-oriented relative to a beam" and similar expressions mean that an item is located to the left of the longitudinal midpoint of the beam when the base is viewed in its operative horizontal orientation from the side of the base containing the beam, essentially along a horizontal viewing axis perpendicular to the length of the beam. The term "right-oriented relative to a beam" and similar expressions mean that an item is located to the right of the longitudinal midpoint of the beam in such viewing.

Other aspects of the invention, including methods of constructing swing stage bases, will be apparent from a description below of a preferred embodiment and will be more specifically defined in the appended claims.

DESCRIPTION OF THE DRAWINGS

The invention will be better understood with reference to drawings in which.

DESCRIPTION OF PREFERRED EMBODIMENTS

Figure 1:
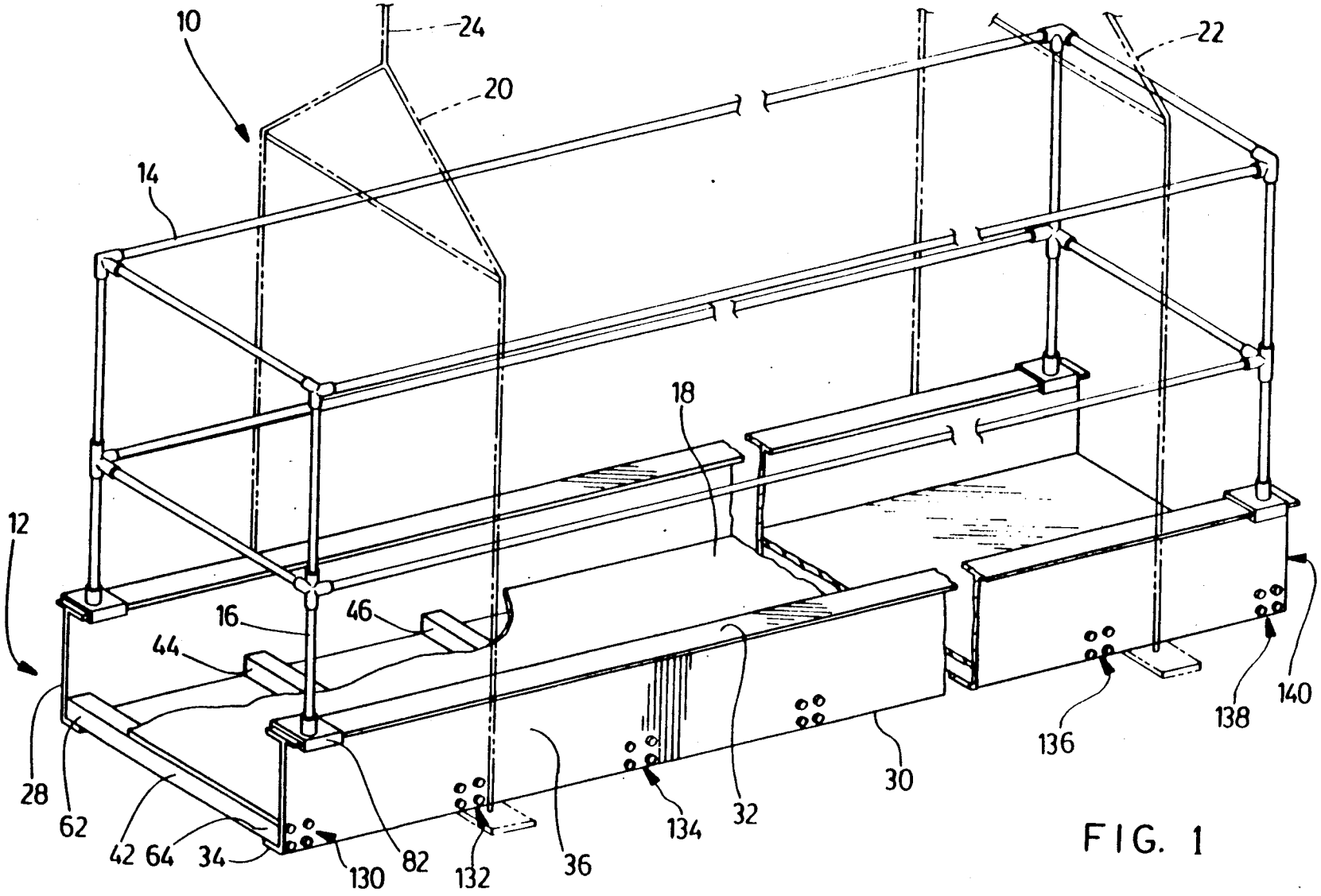
FIG. 1 is a fragmented perspective view of a swing stage constructed according to the invention.

Reference is made to FIG. 1 which illustrates a swing stage 10 comprising a base 12 and an enclosing structure 14. The enclosing structure 14 in this instance is a handrail assembly comprising several vertical posts (such as the post 16 specifically indicated), horizontal tubes, and standard releasable fittings joining the tubes to the posts. Plywood floor panels (such as the panel shown fragmented and identified with reference numeral 18) are supported by the base 12 and define a floor for workmen. The base 12 may be suspended by a pair of stirrups 20, 22 and cables, such as the cable 24, diagrammatically indicated in phantom outline.

Figure 2:
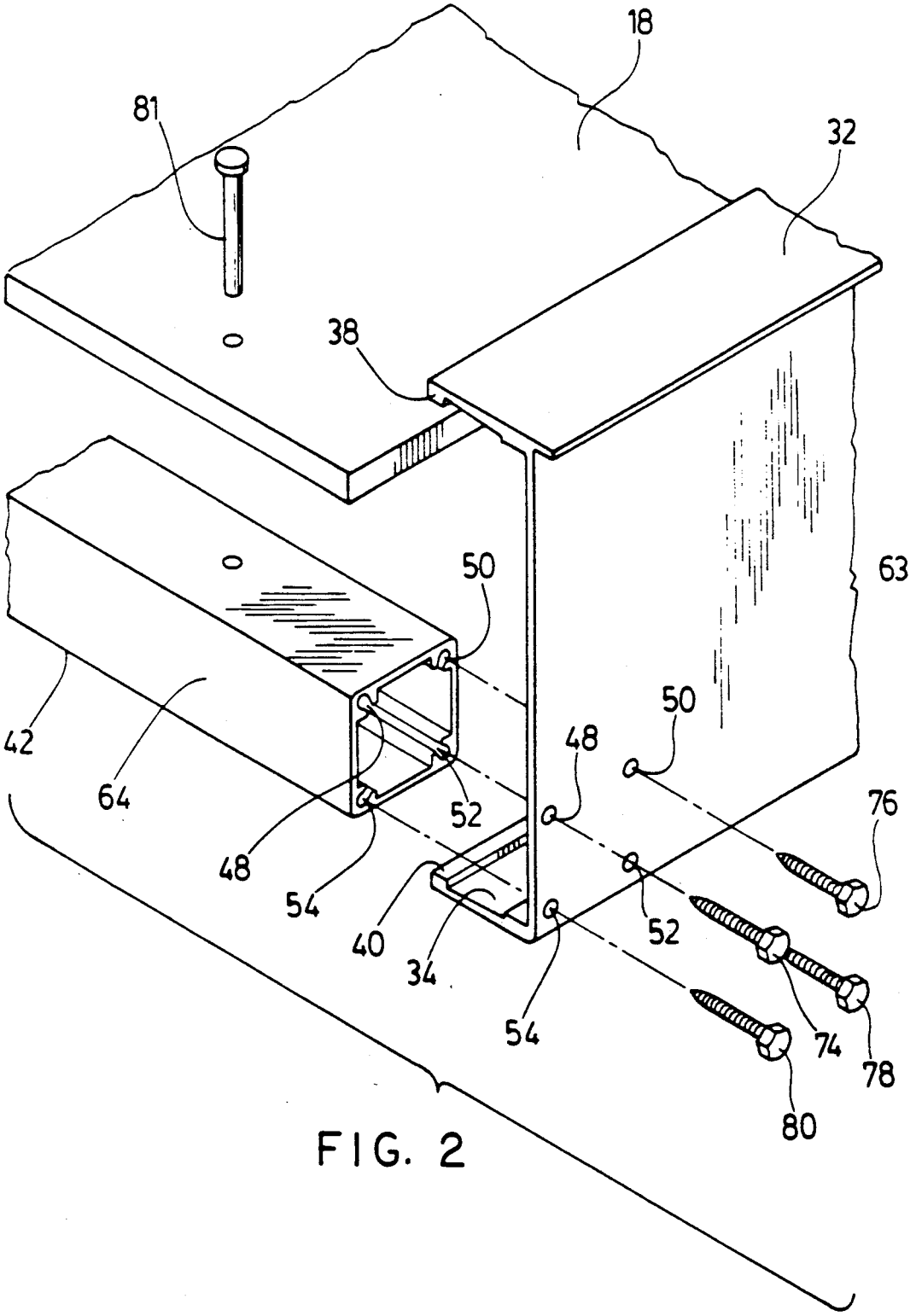
FIG. 2 is an enlarged, exploded view of a junction between a cross-member and a principal beam of the swing stage.

The base 12 comprises a pair of identical extruded aluminum beams 28, 30. One beam 30, which is typical, has a generally C-shaped cross-section, as apparent in FIG. 2. It comprises an upper flange 32, a lower flange 34, and a vertical web 36 joining the flanges 32, 34. The upper flange 32 has a longitudinal, downwardly-directed lip 38, distal from the web 36. The lower flange 34 has a similar longitudinal lip 40, distal from the web 36, but upwardly-directed.

Figure 3:
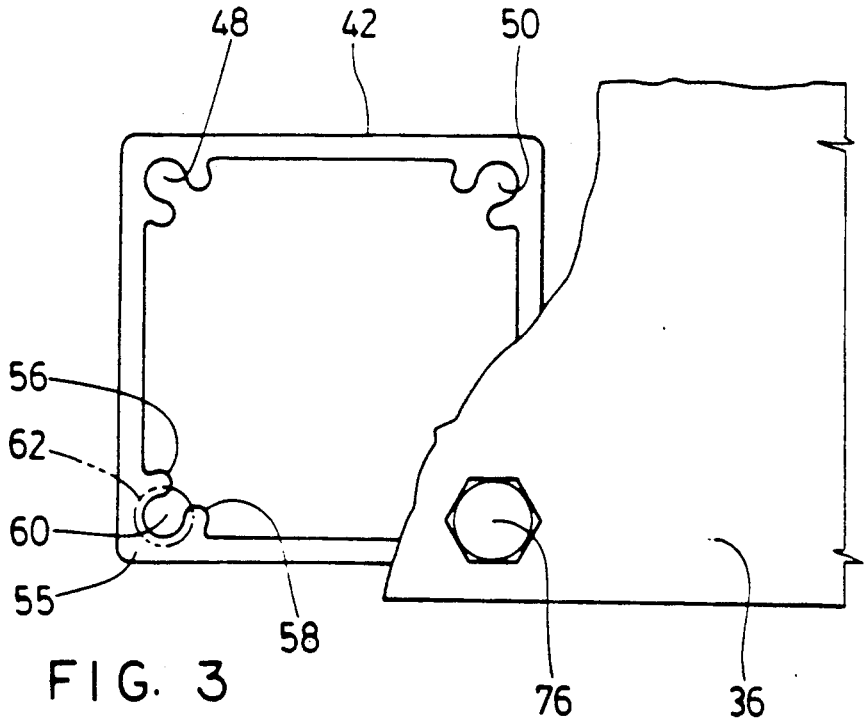
FIG. 3 is a fragmented side elevation showing the cross-section of the cross-member and detailing certain screw-receiving structures associated with the cross-member.

A multiplicity of identical extruded aluminum cross-members join the beams 28, 30. Three such cross-members are apparent in FIG. 1 and have been identified with reference numerals 42, 44 and 46. The various cross-members are spaced-apart horizontally at 16 inch intervals and oriented perpendicular to the beams 28, 30. One cross-member 42 is typical and shown in detail in FIGS. 2-3. It has a generally square cross-section with 4 inch sides. It is integrally extruded with longitudinal structure defining a set of four identical, longitudinal screw-receiving passages 48-54 (even numbers only) in a square spacing arrangement, the spacing between adjacent pairs of the passages 48-54 being slightly less than 4 inches. The passage-defining structure at one corner 55 is typical. It comprises a pair of longitudinal ribs 56, 58, one to either side of the corner 55, separated by a gap 60. The size of the gap 60 is determined by the nature of the screws that are used to assemble the base 12 and that are ultimately threaded into the longitudinal ribs 56, 58 defining the gap 60. The peripheral transverse cross-section 62 of a screw is shown in FIG. 3 in phantom outline, superimposed over the passage 54, to indicate the threading that occurs.

Each of the opposing end portions 62, 64 of the cross-member 42 is proximate to and butted against the web of a different one of the pair of beams 28, 30. The junction between one cross-member end portion 64 and the beam 30 is typical. It is shown in detail in the exploded perspective view of FIG. 4. Four apertures 66-72 are formed in the web 36 of the beam 30. These observe the same spacing arrangement as the four screw-receiving passages 48-54 of the cross-member 42 so that each aperture can register with a different one of the screw-receiving passages 48-54. A set of four screws 74-80 with self-tapping threaded shanks with right-hand screw threads secure the junction. The threaded shank of each screw is extended through a different one of the apertures 66-72 into the screw-receiving passage registered with the aperture. Each screw is then rotated to thread its shank into the paired longitudinal ribs defining the screw-receiving passage. Rotation of the screws 74-80 incidentally draws the cross-member end portion 64 into abutting relationship with the web 36. The longitudinally opposite end portion 62 of the cross-member is retained in a similar junction at the other beam 28. The other cross-members are similarly joined to the beams 28, 30.

The height of the beam 30, as measured between the flanges 32, 34, is approximately nine inches. The set of apertures 66-72 in the web 36 are formed proximate to the lower flange 40. In fact, a multiplicity of such aperture sets observing the same spacing arrangement are formed along the web 36 of the beam 30 at 16 inch intervals and at a common height. Similar sets are formed in the web of the other beam 28. The assembly of cross-members are consequently at a common height and define a relatively level upper surface to receive the flooring panels. The additional height of the beams 28, 30 relative to the cross-members and the positioning of the cross-members proximate to the lower flanges of the beams 28, 30 serves effectively to define toe-boards to either side of the flooring panels that contains any tools or the like deposited on the flooring. This reduces the likelihood of materials dropping from the swing stage 10, without requiring enclosing mesh as in prior ladder-type devices. The flooring panels are preferably secured with rivets (such as the rivet 81 illustrated in FIG. 2) to the cross-members thereby preserving the relative spacing of the cross-members upon disassembly of the swing stage base 12. The combination of cross-members and panels need not be further disassembled, as they define a relatively planar structure that can be compactly stored or transported.

Figure 4:
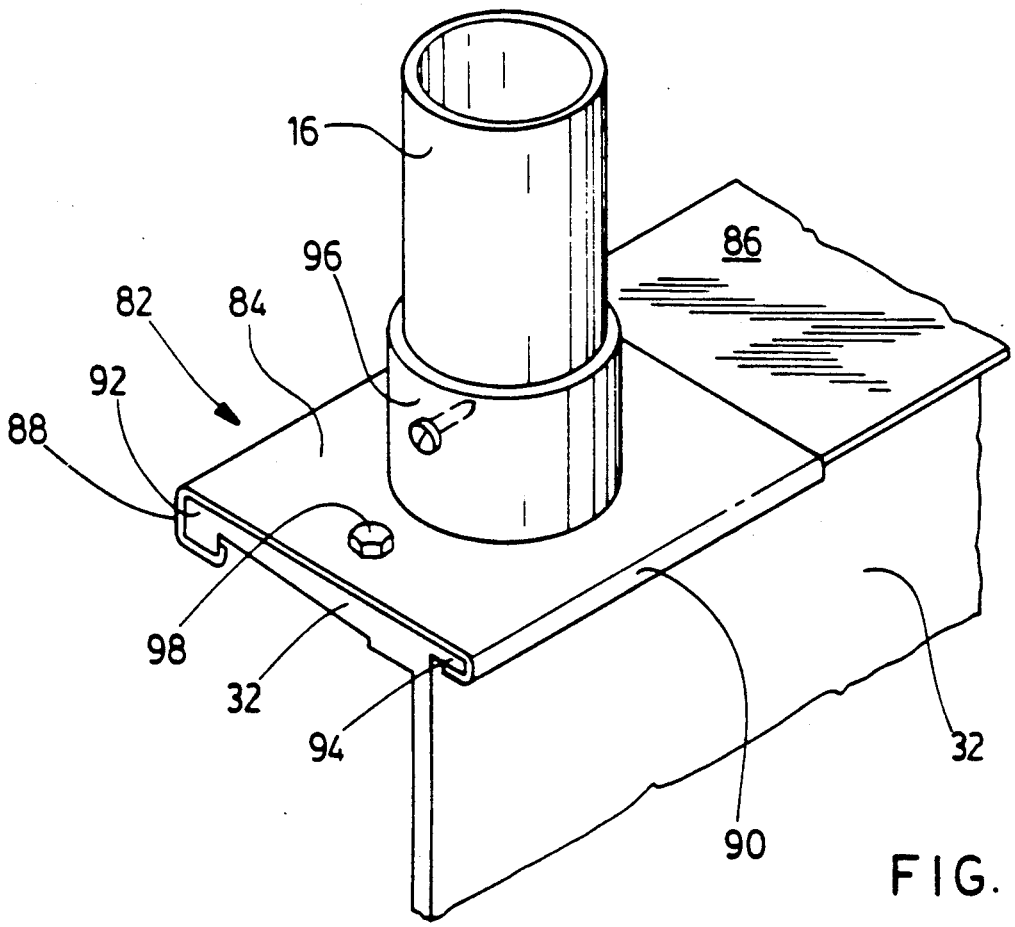
FIG. 4 is a fragmented perspective view showing a bracket and post-supporting member that are displaceable along the beam; and, FIG. 5 is a fragmented perspective view showing an alternative construction of a bracket and post-supporting means.

FIG. 4 illustrates a preferred means for retaining, for example, the post 16 (shown fragmented) of the enclosing structure 14. A bracket 82 is shaped to slide along the upper flange 32 of the beam 30. The transverse cross-section of the bracket 82 is selected to closely receive the transverse cross-section of the flange 32 in an interlocking relationship that resists separation in any direction transverse to the longitudinal axis of the beam. The bracket 82 comprises a central portion 84 that overlays the upper surface 86 of the beam (defined by the upper flange 32), and a pair of curved lateral portions 88, 90 each extending around a different one of the lateral edge portions 92, 94 of the flange 32. A tubular post-receiving member 96 is attached to the central portion 84 and extends upwardly to receive the post 16 of the enclosing structure 14. Since the transverse cross-sections are uniform along both the beam and the bracket 82, the bracket 82 can slide along the length of the beam to any desired position. A set screw 98 permits the bracket 82 to be fixed at the desired position. A plurality of such brackets are associated with each of the beams 28, 30 to receive the various vertical posts of the enclosing structure 14. The advantage of this arrangement is that one can readily replace the enclosing structure 14 with another, without concern regarding alignment of posts with the post-receiving means of the base 12.

Figure 5:
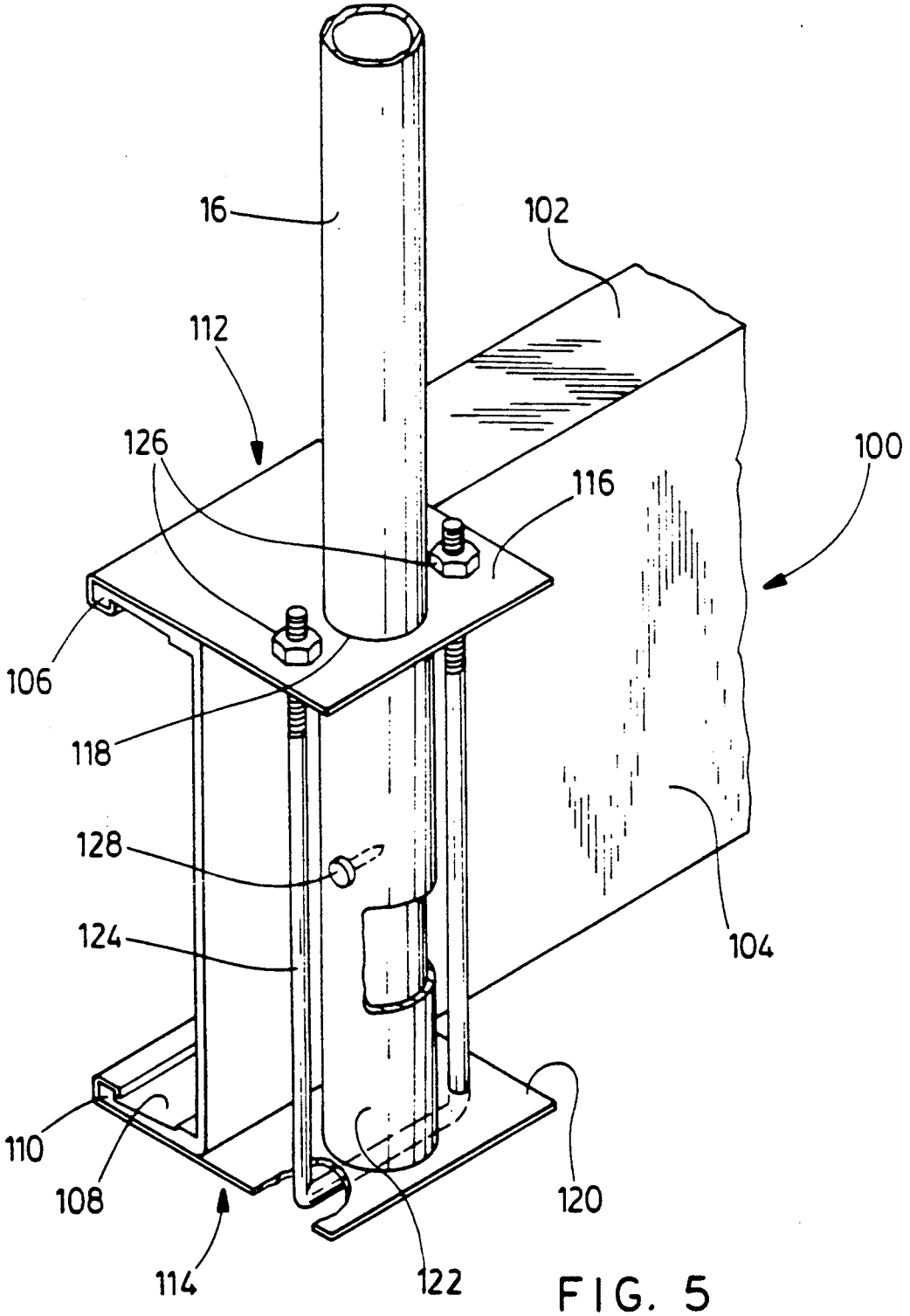

FIG. 5 illustrates an alternative means of securing the vertical post 16 of the enclosing structure 14. This is illustrated in connection with an alternative extruded aluminum beam 100 having substantially the same C-shaped cross-section as the beam 30. However, the beam 100 has an upper flange 102 that is not extended laterally to both sides of its web 104, but does have a downwardly-depending longitudinal lip 106 distal from the web 104. The lower flange 108 also has a longitudinal lip 110, distal from the web 104, but extending upwardly. Two brackets 112, 114 are used, an upper bracket 112 overlaying the upper surface of the beam 100, and a lower bracket 114 overlaying the lower surface of the beam 100. The upper bracket 112 has an internal cross-section complementary to the cross-section of the upper flange 102. The bracket 112 is shaped to closely receive, internally, the downwardly depending lip 106 of the upper flange 102. The complementary cross-sections of the flange 102 and bracket 112 permit the bracket 112 to be slid onto the flange 102 one end of the beam 100. Once again, the bracket 112 can slide along the beam 100 to any desired location, but is interlocked to resist removal in any direction transverse to the longitudinal axis of the beam 100. The lower bracket 114 observes a similar relationship with the lower flange 108.

The upper bracket 112 has an extension 116 formed with a central clearance hole 118. The lower bracket 114 has an extension 120 that can be aligned vertically with the upper extension 120. A length of pipe 122 is located between the upper and lower extensions 116, 118 in vertical alignment with the central clearance hole 118. The diameter of the central clearance hole 118 is sufficient to receive the post 16, but not the length of pipe 122. The pipe 122 is clamped between the two extensions 116, 120 by a U-bolt 124 whose legs extend through clearance holes (not illustrated) in the extensions 116, 120 and are secured with a pair of nuts 126 at the upper extension 116. The pipe 122 has an internal diameter just sufficient to receive the post 16 (as apparent in FIG. 5 where the pipe 122 is shown fragmented). A screw 128 may be used to secure the post 16 to the pipe 122. Although such paired brackets 112, 114 permit posts of an enclosing structure 14 to be received at various locations along the beam 100, the brackets of FIG. 4 are strongly preferred for ease of construction and handling.

The swing stage base 12 will typically be constructed as a knock-down kit. The pair of aluminum beams 28, 30 are formed as identical extrusions. Identical cross-members can be cut from single or multiple identical extrusions to substantially identical lengths. Several sets of apertures, each observing the spacing arrangement characteristic of the screw-receiving passages 48–54, are drilled at required intervals along the length of the web of the beam 30. A corresponding number of sets of apertures, also observing the spacing arrangement of the screw-receiving passages, are drilled at comparable positions along the length of the other beam 28. This ensures that each cross-member can be positioned between the beams 28, 30 with its set of screw-receiving passages simultaneously registered with a set of apertures of one beam and a corresponding set in the other beam. An appropriate quantity of self-tapping screws may be provided, and a multiplicity of brackets like the bracket 82, to permit receipt of vertical posts of a desired enclosing structure. This kit will, of course, be easier and less costly to transport than the prior ladder-like bases. Several can potentially be transported in the volume of occupied by a single prior swing stage base.

Assembly of the kit is sufficiently simple that it may be left to the end user. He simply orients the pair of beams 28, 30 in parallel relationship, separated by a distance required to accommodate the cross-members in perpendicular relationship relative to the beams 28, 30. He positions each cross-member such that its set of screw-receiving passages are registered with one set of apertures in one beam and a corresponding set in the other beam. He insert a screws through each apertures into the registered screw-receiving passages of the cross-member and rotates the screw to thread its shanks into the pair of ribs defining the screw-receiving passage. Once the base 12 has been assembled, the end user can slide the brackets onto the beams 28, 30 as required, and locate them as required to receive posts of a desired enclosing structure. He may fasten floor panels to the cross-members in any desired manner, as with rivets.

Swing stage bases embodying the basic principles of the invention can readily be designed to have a structural rigidity comparable to or exceeding that of prior swing stage bases of rigid ladder-like construction (given a predetermined weight per linear foot). One unexpected shortcoming in preliminary prototypes, however, was insufficient ability to resist twisting about a horizontal axis perpendicular to the principal beams, the beams effectively rotating relative to one another. Such twisting forces are apt to be significant, for example, where one workman stands to one side of the swing stage at one end and another workman stands to an opposing side at an opposite end. This problem appears attributable to use of extruded structure to receive the screws. A conventional solution to this problem might involve a greater number of cross-members, a larger number of screws to secure each cross-member, and a general increase in the size of the cross-members and screws. However, this may increase weight and increase the number of parts that must be assembled. Alternative solutions to this problem have been developed and are discussed below.

The twisting problem can be accommodated in part by selection of the orientation of the screw threads in the various sets securing the cross-members to the beams 28, 30. In particular, with reference to FIG. 1, the screws that are left-oriented relative to the beam 30, such as sets 130, 132, 134, securing the cross-members 42–46, have right-hand screw threads. They tighten in response to clockwise rotation of their heads. The screws in the sets that are right-oriented, such as sets 136, 138, have left-hand screw threads which tighten in response to counter-clockwise rotation of their heads. The screws of the other beam 28 are similarly oriented relative to that beam. For example, the sets securing the cross-members 42–44 to the beam 28 have left-hand screw threads since these sets are right-oriented relative to the beam 28. The twisting problem necessarily requires a corner of the base 12 to rise relative to adjacent corners. If, for example, the forward right-hand corner 140 of the base 12 rises relative to adjacent corners, the screws of sets 136, 138 tend to tighten, thereby resisting the twisting effect, rather than loosening and potentially increasing the bending of the structure. This arrangement can be applied to any base in which webs of two beams are joined by aluminum cross-members using integrally extruded structures defining screw-receiving passages. The screw sets proximate to corners of the base 12 appear most critical for such purposes.

The cross-section of the cross-members and the orientation of the longitudinal screw-receiving passages have also been selected to reduce twisting. An alternative construction, tested by the inventor, involved a solid I-beam profile. Two vertically spaced-apart screw-receiving passages were formed on the web of the I-beam profile with integrally extruded longitudinal structures comprising paired ribs. The test prototype displayed excellent structural rigidity, except for twisting of the base along a horizontal axis perpendicular to its length. This twisting might be accommodated by increasing the size of the I-beams and providing additional screw-receiving passages with greater relative spacing. The rectangular arrangement with screw-receiving passages at corners offers better resistance to such twisting effects for cross-members of comparable cross-sectional dimensions and strength.

The invention can be implemented with only a single screw joining each cross-member end portion to a proximate beam. For example, the beams may be extruded with several internal radial ribs, circumferential spaced and dimensioned to define a central screw-receiving passage. A single large screw may be threaded into portions of the ribs distant from their points of connection to the rest of the cross-member. For each beam, a number of screws that are left-oriented relative to the beam may be formed with right-hand screw threads and a number that are right-oriented may be formed with left-hand screw threads to resist twisting about a horizontal axis perpendicular to the beams. Floor panels secured to the beams will tend to maintain their orientation and prevent rotation. Multiple screws at each junction are strongly preferred, however, to reduce the size of the ribs that must be extruded and to permit screws to be spaced to enhance resistance to twisting.

It will be appreciated that particular embodiments of the invention have been described and that modifications may be made therein without departing from the spirit of the invention or necessarily departing from the scope of the appended claims.

I claim:

1. A knock-down swing stage base comprising:

a pair of aluminum beams in substantially parallel, spaced-apart relationship;

a multiplicity of aluminum cross-members horizontally spaced relative to one another and located between the beams, each of the cross-members being integrally extruded with longitudinal structure defining a longitudinal screw-receiving passage;

each cross-member comprising one end portion proximate to one of the beams and a longitudinally opposite end portion proximate to the other of the beams, each of the cross-member end portions being releasably joined to the proximate beam in a junction comprising:

(a) an aperture formed in the proximate beam and registered with the screw-receiving passage of the cross-member comprising the end portion, and, (b) a screw extending through the aperture into the screw-receiving passage registered with the aperture and threaded into the longitudinal structure defining the screw-receiving passage registered with the aperture.

2. The knock-down swing stage base of claim 1 in which:

each of the beams comprises a generally vertical web;

the aperture of each of the junctions is formed in the web of the proximate beam; and with respect to each beam, a preselected number of the screws that extend through the beam are left-oriented relative to the beam and have a right-hand screw thread and a preselected number of the screws that extend through the beam are right-oriented relative to the beam and have a right-hand screw thread whereby the base resists twisting about a horizontal axis perpendicular to the beams.

3. The knock-down swing stage base of claim 2 in which, in each of the cross-members, the longitudinal structure defining the screw-receiving passage of the cross-member comprises longitudinal ribs.

4. The knock-down swing stage of claim 1 in which for each of the cross-members:

the screw-receiving passage is one of a set of longitudinal screw-receiving passages in a predetermined spacing arrangement and defined by the longitudinal structure extruded with the cross-member;

in the junction joining each of the end portions of the cross-member to the proximate beam:

(a) the aperture of the junction is one of a set of apertures in the predetermined spatial relationship and registered with the set of longitudinal screw-receiving passages;

(b) the screw is one of a set of screws each extending through a different aperture of the set of apertures into the set of screw-receiving passages and threaded into the longitudinal structure defining the set of screw-receiving passages.

5. The knock-down swing stage base of claim 4 in which:

each of the cross-members has a generally rectangular, hollow cross-section and four corners; and, the longitudinal structure defining the screw-receiving passages of each of the cross-members comprises paired longitudinal ribs located within the cross-member, each pair of longitudinal ribs being associated with a different one of the corners of the cross-member, each of the paired longitudinal ribs comprising one rib located to one side of the associated corner and another rib located to the other side of the associated corner, the one and other ribs being separated by a gap of predetermined size.

6. The knock-down swing stage base of claim 1 in which:

each of the beams is an aluminum extrusion integrally extruded with a longitudinal structure of uniform transverse cross-section;

a plurality of brackets is associated with each of the beams, each of the brackets comprising a structure mated with the structure of the associated beam such that the bracket can be slid along the associated beam to a desired position and resists removal from the associated beam in any direction transverse to a longitudinal axis of the associated beam; and, each of the brackets comprises post-receiving means for releasably receiving and retaining a post in a generally vertical orientation.

7. The knock-down swing stage base of claim 1 in which:

each of the beams is an aluminum extrusion comprising a generally horizontal flange which defines an upper surface of the beam and which comprises a pair of opposing lateral edge portions;

a plurality of brackets is associated with each of the beams;

each of the brackets is shaped to slide along the flange of the associated beam and comprises a central portion overlaying the upper surface of the associated beam and a pair of lateral portions joined by its central portion, each of the lateral portions of the bracket extending around a different one of the lateral edge portions of the flange of the associated beam thereby to secure the bracket to the beam against removal in any direction transverse to a longitudinal axis of the associated beam; and, each of the brackets comprises a post-receiving member attached to and extending upwardly from its central portion.

8. In a swing stage base comprising a pair of elongate beams in substantially parallel, spaced-apart relationship, improved apparatus for receiving vertical posts of a suprajacent enclosing structure at various positions along the beams, the apparatus comprising:

a structure extending longitudinally along each of the beams and having a substantially uniform transverse cross-section, the structure of each of the beams comprising a generally horizontal flange which defines an upper surface of the beam and which comprises a pair of opposing lateral edge portions;

a plurality of brackets associated with each of the beams, each of the brackets comprising a complementary structure mated with the structure of the associated beam such that the bracket is secured to the associated beam against removal in any direction transverse to a longitudinal axis of the associated beam and such that the bracket can be slid to various positions along the associated beam, the complementary structure of each of the brackets comprising a central portion overlaying the upper surface of the associated beam and a pair of lateral portions joined by its central portion, each of the lateral portions of the bracket extending around a different one of the lateral edge portions of the flange of the associated beam; and, each of the brackets comprising post-receiving means for releasably receiving and retaining a post of the enclosing structure in a generally verticalorientation, the post-receiving means of each bracket comprising a post-retaining member attached to and extending upwardly from its central portion.

9. A knock-down base comprising:

a pair of aluminum beams in substantially parallel, spaced-apart relationship, each of the beams comprising a generally vertical web; and, a multiplicity of aluminum cross-members horizontally spaced relative to one another and located between the beams, each of the cross-members being integrally extruded with longitudinal structure defining a longitudinal screw-receiving passage, each of the cross-members comprising one end portion proximate to the web of one of the beams and a longitudinally opposite end portion proximate to the web other of the beams;

each of the cross-member end portions being releasably joined to the proximate beam in a junction comprising:

(a) an aperture formed in the web of the proximate beam and registered with the screw-receiving passage of the cross-member comprising the end portion, and (b) a screw extending through the aperture into the screw-receiving passage registered with the aperture and threaded into the longitudinal structure defining the screw-receiving passage registered with the aperture;

with respect to each beam, a preselected number of the screws that extend through the beam are left-oriented relative to the beam and have a right-hand screw thread and a preselected number of the screws that extend through the beam are right-oriented relative to the beam and have a right-hand screw thread whereby the base resists twisting about a horizontal axis perpendicular to the beams.

10. A method of making a knock-down swing stage base, comprising:

extruding a pair of aluminum beams;

extruding a multiplicity of aluminum cross-members, including integrally extruding each of the cross-members with longitudinal structure defining a longitudinal screw-receiving passage;

releasably joining each of the cross-members to the pair of beams such that the beams are maintained in parallel, spaced-apart relationship, the joining of each cross-member comprising (a) forming a first aperture in a first of the pair of beams;

(b) forming a second aperture in the second of the pair of beams;

(c) positioning the cross-member relative to the beams such that the screw-receiving passage of the cross-member is registered with the first aperture at one end of the cross-member and registered with the second aperture at a longitudinally opposing end of the cross-member;

(d) inserting a first screw through the first aperture and a second screw threw the second aperture into the screw-receiving passage registered with the first and second apertures and rotating the first and second screws such that the screws are threaded into the longitudinal structure of the cross-member defining the screw-receiving passage.

11. The method of claim 10 in which the inserting of the screws joining the multiplicity of cross-members to the beams comprises, for each of the beams, inserting right-hand screws in a preselected number of apertures formed in the beam that are left-oriented relative to the beam and left-hand screws in a preselected number of the apertures formed in the beam that are right-oriented relative to the beam.

12. The method of claim 10 adapted to produce a knock-down swing stage base capable of receiving vertical posts of a suprajacent enclosing structure at various positions along the beams, comprising:

selecting a first transverse cross-section and a second transverse cross-section shaped to closely receive the first cross-section internally in a transversely interlocked relationship;

integrally extruding each of the beams with a structure longitudinally directed along the beam and having a uniform transverse cross-sections corresponding to one of the first and second cross-sections;

forming a multiplicity of brackets each comprising a structure with a substantially uniform transverse cross-section corresponding to the other of the first and second cross-sections;

attaching a post-receiving member to each of the brackets;

sliding the brackets onto the beams such that the structure of each of the brackets is transversely interlocked with the structure of the beam on which the bracket is located.

13. The method of claim 10 adapted to produce a knock-down swing stage base capable of receiving vertical posts of a suprajacent enclosing structure at various positions along the beams, comprising:

integrally extruding each of the beams with a generally horizontal flange which defines an upper surface of the beam and which comprises a pair of opposing lateral edge portions, the flanges of the beams being substantially identical;

forming a multiplicity of brackets shaped to receive the flange of either of the beams internally in sliding relative relationship, each of the brackets comprising a central portion shaped to overlay the upper surface of the beam comprising the received flange and a pair of opposing lateral portions joined by the central portion and shaped to extend around a different one of the lateral edge portions of the received flange;

securing a post-receiving member to the central portion of each of the brackets;

sliding the brackets onto the flanges of the beams.

* * * * *